US011450499B2

(12) United States Patent
Gibson

(10) Patent No.: US 11,450,499 B2
(45) **Date of Patent: *Sep. 20, 2022**

(54) SWITCHING SYSTEM, AND ELECTRICAL SWITCHING APPARATUS AND SWITCHING ASSEMBLY THEREFOR

(71) Applicant: EATON INTELLIGENT POWER LIMITED, Dublin (IE)

(72) Inventor: Jeffrey Gibson, Hookstown, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 17/120,465

(22) Filed: Dec. 14, 2020

(65) Prior Publication Data

US 2021/0098220 A1 Apr. 1, 2021

Related U.S. Application Data

(63) Continuation of application No. 15/742,478, filed on Oct. 4, 2017, now Pat. No. 10,896,796.

(51) Int. Cl.
*H01H 71/12* (2006.01)
*H01H 3/26* (2006.01)
*H01H 3/40* (2006.01)

(52) U.S. Cl.
CPC ..... *H01H 71/12* (2013.01); *H01H 3/26* (2013.01); *H01H 3/40* (2013.01); *H01H 2003/266* (2013.01)

(58) Field of Classification Search
CPC ..... H01H 3/26; H01H 3/40
(Continued)

(56) References Cited

U.S. PATENT DOCUMENTS 1,839,377 A * 1/1932 Daly ..... H01H 50/56 335/125
2,262,306 A * 11/1941 Thompson ..... H01H 19/64 200/6 BB (Continued)

OTHER PUBLICATIONS

Schneider Electric USA, "Products Guide", Apr. 2013, pp. 1-156 (see pp. 75-76), www.schneider-electric.us, Document No. 1200CT0701R11/12.

*Primary Examiner* — Alexander Talpalatski
(74) *Attorney, Agent, or Firm* — Eckert Seamans Cherin & Mellott, LLC

(57) ABSTRACT

A switching assembly is for an electrical switching apparatus of a switching system. The electrical switching apparatus includes a base. The switching system has a communication device. The switching assembly includes a number of contact assemblies coupled to the base, each of the contact assemblies having a stationary contact and a movable contact structured to move between a CLOSED position corresponding to engagement with the stationary contact, and an OPEN position corresponding to disengagement with the stationary contact; and a transfer assembly including an element and only one single actuator coupled to the element, the element being structured to be coupled to the base, the single actuator comprising a controller for receiving a signal from the communication device. The single actuator is structured to move the movable contact of each of the number of contact assemblies between the CLOSED position and the OPEN position.

20 Claims, 9 Drawing Sheets

(58) Field of Classification Search
USPC ..... 335/123
See application file for complete search history.

(56) References Cited

U.S. PATENT DOCUMENTS

| | | | | | |
|---|---|---|---|---|---|
| 3,067,305 | A * | 12/1962 | Stout | H01H 51/01 | 335/81 |
| 3,914,725 | A * | 10/1975 | Williamson | H01H 51/086 | 335/140 |
| 6,756,549 | B2 * | 6/2004 | Suzuki | H01H 1/66 | 200/19.07 |
| 6,765,157 | B2 * | 7/2004 | Rademacher | H01H 3/26 | 200/1 R |
| 8,116,919 | B2 * | 2/2012 | Naumann | H01H 9/167 | 700/292 |
| 9,013,174 | B2 * | 4/2015 | Loy | H01H 3/40 | 324/137 |
| 10,032,590 | B2 * | 7/2018 | Hiremath | H05K 5/0026 | |
| 2005/0001700 | A1 * | 1/2005 | Lewis | H01H 71/70 | 335/14 |
| 2005/0258921 | A1 * | 11/2005 | Puskar | H01H 71/0228 | 335/17 |

* cited by examiner

SWITCHING SYSTEM, AND ELECTRICAL SWITCHING APPARATUS AND SWITCHING ASSEMBLY THEREFOR

CROSS-REFERENCE TO RELATED APPLICATION

This application is a continuation of, and claims priority from, U.S. patent application Ser. No. 15/724,748, filed Oct. 4, 2017, entitled "SWITCHING SYSTEM, AND ELECTRICAL SWITCHING APPARATUS AND SWITCHING ASSEMBLY THEREFOR", the contents of which are incorporated herein by reference.

BACKGROUND

Field

The disclosed concept relates generally to switching systems. The disclosed concept also relates to electrical switching apparatus (e.g., without limitation, circuit breakers) for switching systems. The disclosed concept also relates to switching assemblies for electrical switching apparatus.

Background Information

Electrical switching apparatus, such as circuit breakers, are employed in diverse capacities. A circuit breaker may include, for example, a fixed contact and a movable contact, with the movable contact being movable into and out of electrically conductive engagement with the fixed contact. This switches the circuit breaker between an ON or closed position and an OFF or open position, or between the ON or closed position and a tripped or tripped OFF position.

Some known circuit breakers are able to be operated remotely, such as, for example, by a wireless communication device such as a tablet or a cell phone. Such circuit breakers commonly require an additional pole (e.g., without limitation, an additional set of separable electrical contacts and/or an additional circuit) for full functionality. Specifically, such circuit breakers require one pole for remote tripping, and a second pole for ordinary breaker functions. This sacrifices a potential load circuit from a given distribution panel, and also increases the size and cost of the circuit breaker. Additionally, known multi-pole electrical switching apparatus that are able to be operated remotely typically require one actuator for each pole of the circuit breaker, adding cost and increasing the overall footprint of the circuit breaker.

There is, therefore, room for improvement in switching systems, and in electrical switching apparatus and switching assemblies therefor.

SUMMARY

These needs and others are met by embodiments of the disclosed concept, which are directed to an improved switching system, and electrical switching apparatus, and switching assembly therefor.

As one aspect of the disclosed concept, a switching assembly is provided for an electrical switching apparatus of a switching system. The electrical switching apparatus includes a base. The switching system has a communication device. The switching assembly comprises: a number of contact assemblies structured to be coupled to the base, each of the number of contact assemblies comprising a stationary contact and a movable contact structured to move between a CLOSED position corresponding to engagement with the stationary contact, and an OPEN position corresponding to disengagement with the stationary contact; and a transfer assembly comprising an element and only one single actuator coupled to the element, the element being structured to be coupled to the base, the single actuator comprising a controller for receiving a signal from the communication device. The single actuator is structured to move the movable contact of each of the number of contact assemblies between the CLOSED position and the OPEN position.

As another aspect of the disclosed concept, an electrical switching apparatus is provided for a switching system. The switching system has a communication device. The electrical switching apparatus includes a base and the aforementioned switching assembly.

As another aspect of the disclosed concept, a switching system including a wireless communication device and the aforementioned electrical switching apparatus is provided.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
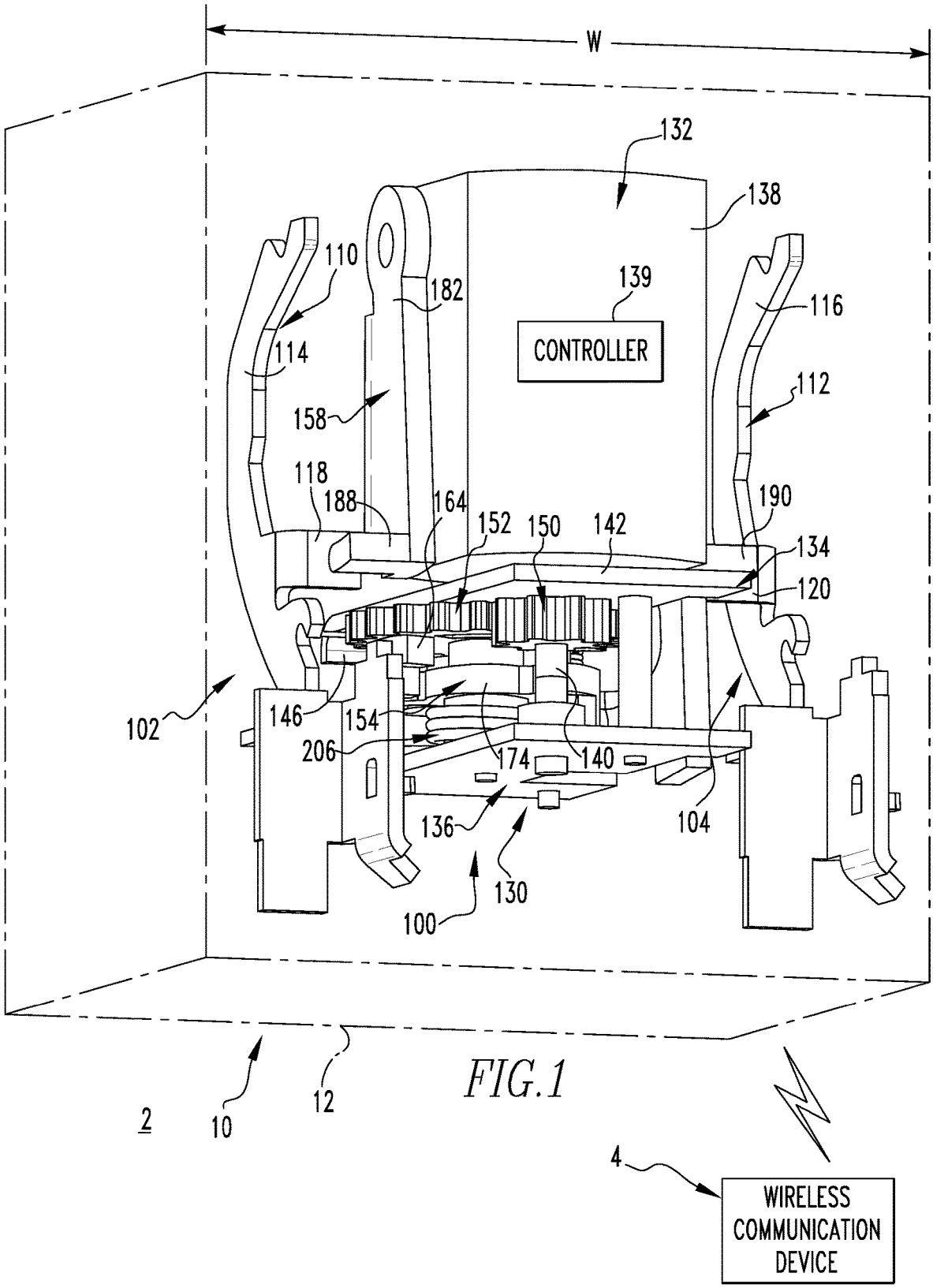
FIG. 1 is a partially simplified isometric view of a switching system, and electrical switching apparatus and switching assembly therefor, shown with the transfer assembly in a FIRST position, in accordance with one non-limiting embodiment of the disclosed concept.

As employed herein, the term "number" shall mean one or an integer greater than one (i.e., a plurality).

As employed herein, the statement that two or more parts are "coupled" together shall mean that the parts are joined together either directly or joined through one or more intermediate parts.

As employed herein, the statement that two or more parts or components "engage" one another shall mean that the parts exert a force against one another either directly or through one or more intermediate parts or components.

As employed herein, the term "wireless communication device" shall mean a device that is structured to send and communicate a signal (e.g., without limitation, a wireless signal) to an external system (e.g., without limitation, an actuator in an electrical switching apparatus).

Directional phrases used herein, such as, for example and without limitation, left, right, upper, lower, front, back, top, bottom, clockwise, counterclockwise, and derivatives thereof, relate to the orientation of the elements shown in the drawings and are not limiting upon the claims unless expressly recited therein.

FIG. 1 is a partially simplified view of a switching system 2, in accordance with one non-limiting example embodiment of the disclosed concept. The example switching system 2 includes a communication device (e.g., without limitation, wireless communication device 4, shown in simplified form) and an electrical switching apparatus (e.g., without limitation, two-pole circuit breaker 10) that is able to be operated by the wireless communication device 4, as will be discussed below. Although the disclosed concept will be discussed in detail herein in association with the circuit breaker 10 be operated remotely by the wireless communication device 4, it is also within the scope of the disclosed concept for a suitable alternative circuit breaker (not shown) to be wired to a programmed controller or manual switch.

The circuit breaker 10 has a base 12 (shown in simplified form in phantom line drawing in FIG. 1) and a switching assembly 100. The switching assembly 100 includes a number of contact assemblies 102,104 that are coupled to the base 12, and a transfer assembly 130. The contact assemblies 102,104 each include a corresponding stationary contact 106,108 and a corresponding movable contact 110, 112 structured to move between a CLOSED position (FIGS. 1-4) corresponding to engagement with the stationary contact 106,108, and an OPEN position (FIG. 5) corresponding to disengagement with the stationary contact 106,108. The transfer assembly 130 has only one single actuator (e.g., without limitation, motor 132). The motor 132 has a body portion 138 having a controller 139 (shown in simplified form in FIG. 1) for receiving wireless signals from the wireless communication device 4.

As will be discussed in greater detail hereinbelow, the single motor 132 is structured to move the movable contacts 110,112 of each of the contact assemblies 102,104 between the CLOSED position and the OPEN position. This is different from prior art remotely operable circuit breakers (not shown), which typically have an additional set of contacts in order to perform traditional breaker functions. Stated differently, the circuit breaker 10 employs the same sets of contacts (i.e., the stationary and movable contacts 106,108,110,112) for remote actuation and for traditional breaker operation. As a result, the circuit breaker 10 is advantageously able to be much more compact and less expensive to manufacture than prior art remotely operable circuit breakers.

Figure 2:
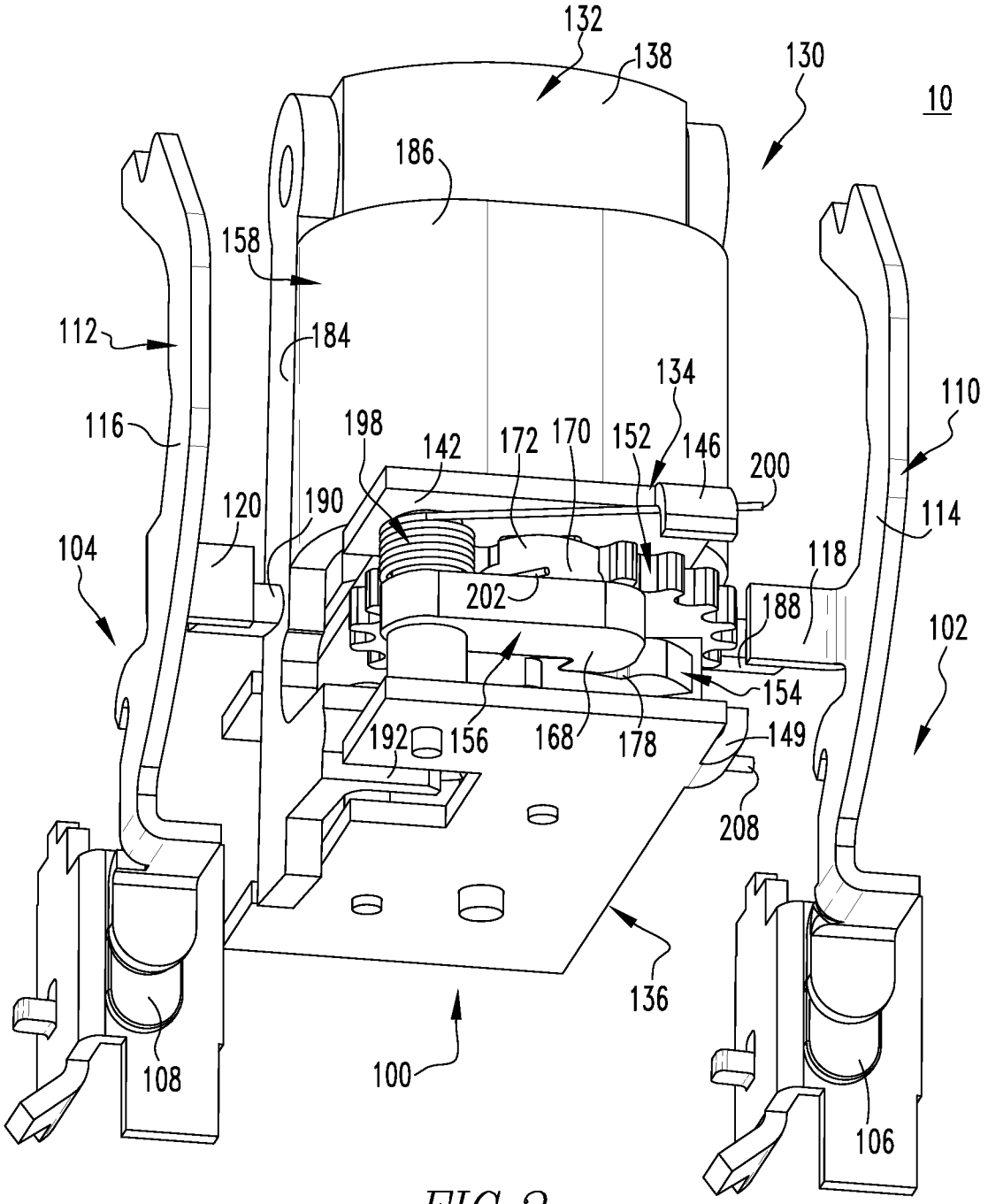
FIG. 2 is a front isometric view of a portion of the electrical switching apparatus and switching assembly therefor of FIG. 1.
Figure 3:
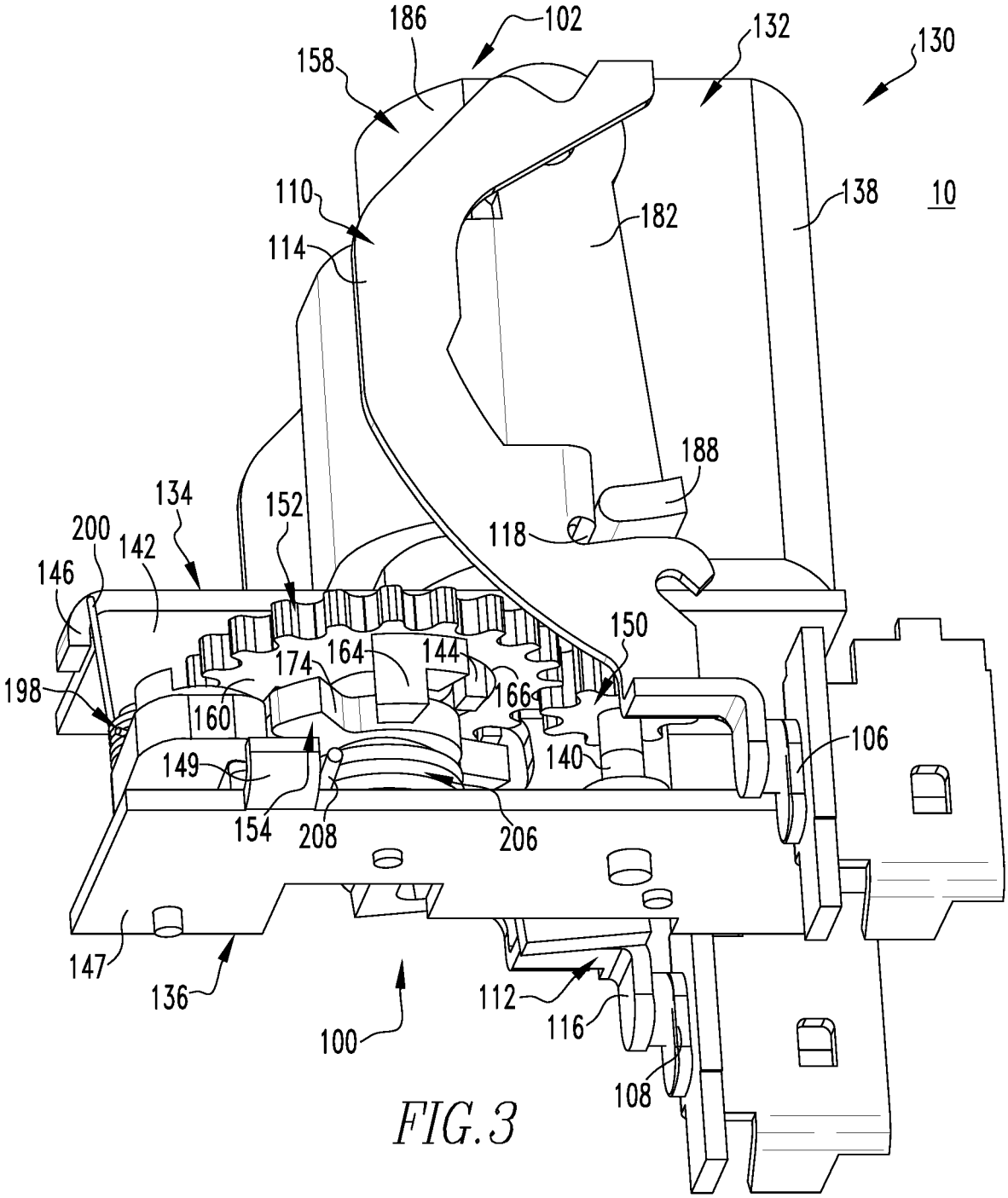
FIG. 3 is a side isometric view of the portion of the electrical switching apparatus and switching assembly therefor of FIG. 2.
Figure 4:
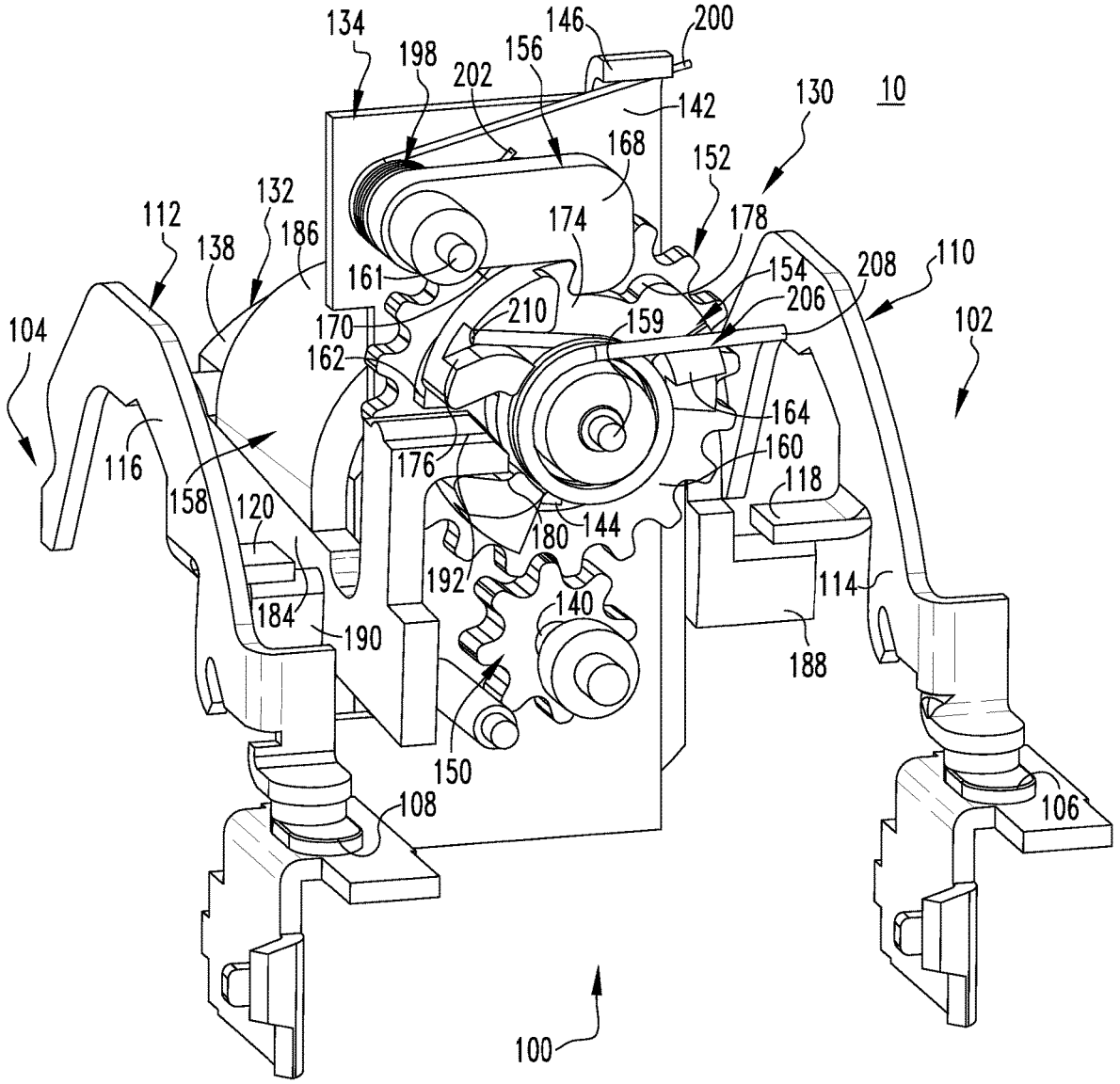
FIG. 4 is a bottom isometric view of the portion of the electrical switching apparatus and switching assembly therefor of FIG. 3, and shown with an element removed in order to see hidden structures.
Figure 5:
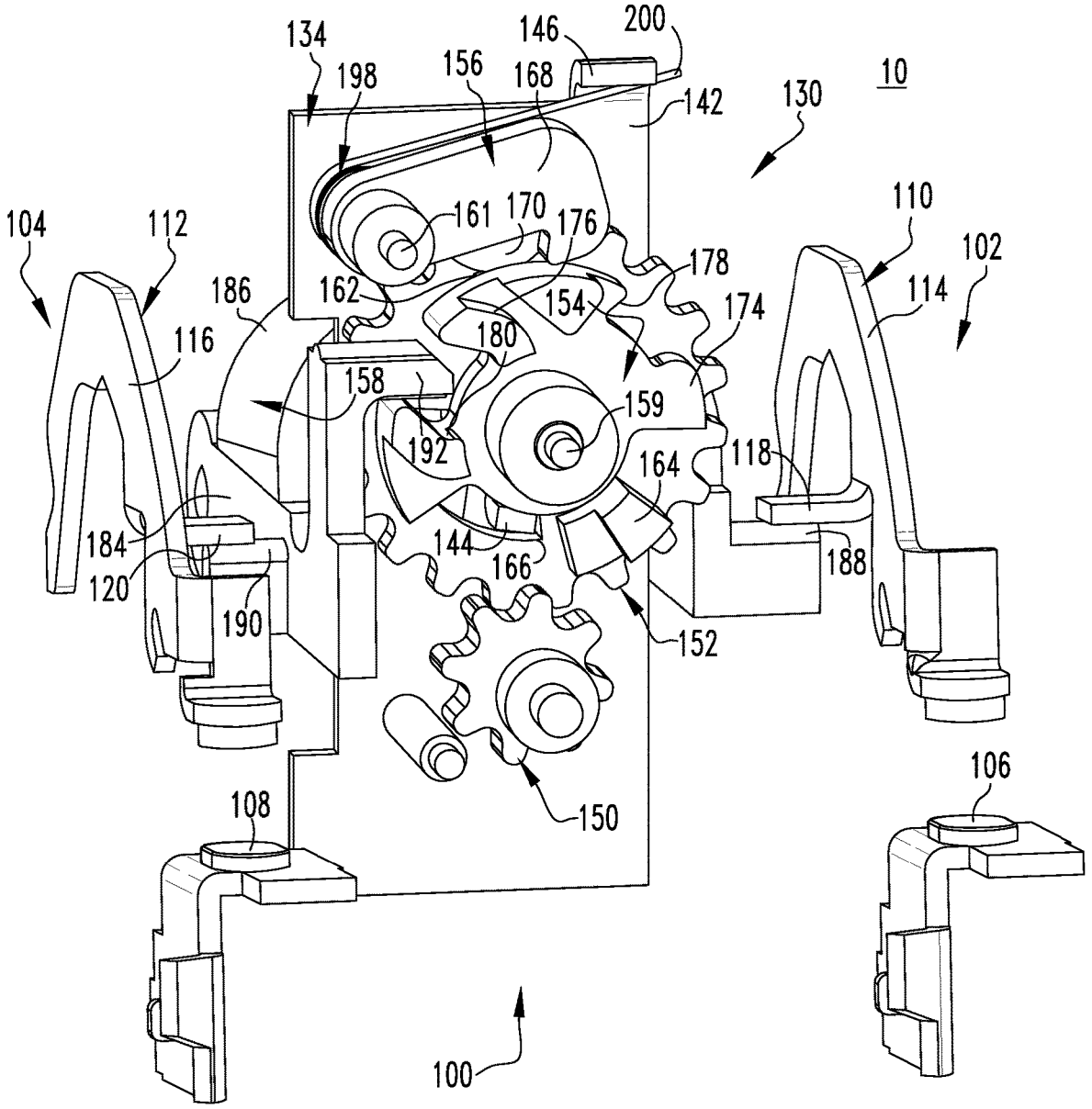
FIG. 5 is a bottom isometric view of the portion of the electrical switching apparatus and switching assembly therefor of FIG. 4, shown without a biasing element, and shown with the transfer assembly in a SECOND position.
Figure 6:
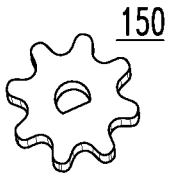
FIG. 6 is a front isometric view of a first gear member for the switching assembly of FIG. 5.
Figure 7:
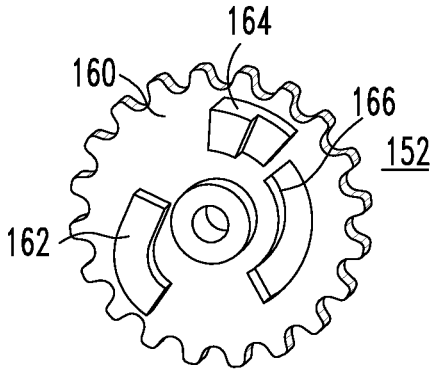
FIG. 7 and FIG. 8 are front isometric and rear isometric views, respectively, of a second gear member for the switching assembly of FIG. 5.
Figure 8:
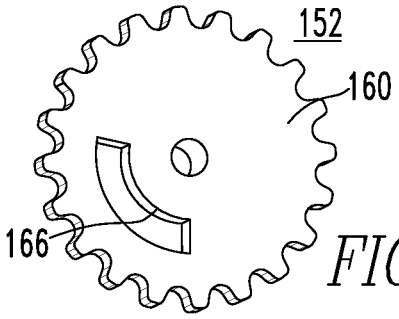
Figure 9:
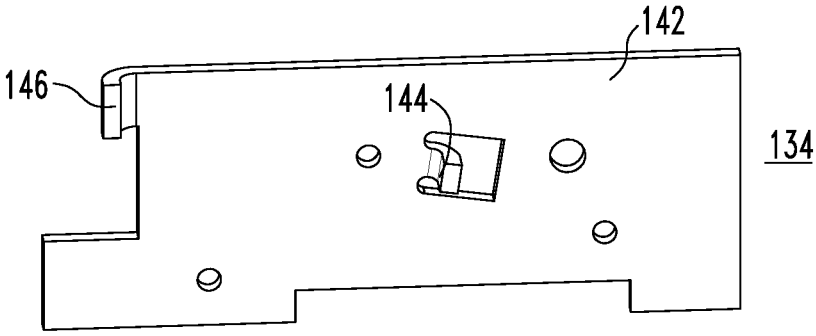
FIG. 9 and FIG. 10 are front isometric and rear isometric views, respectively, of an element for the switching assembly of FIG. 5.
Figure 10:
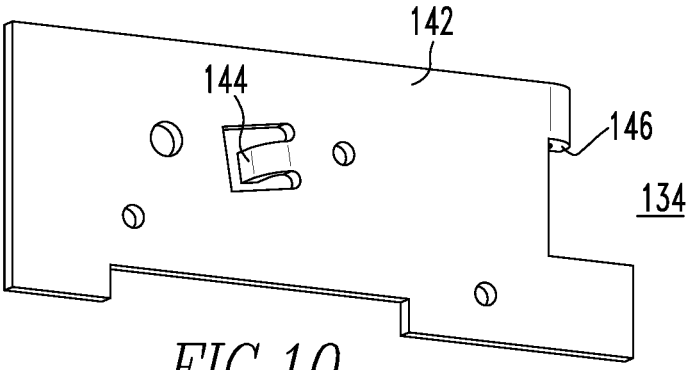
Figure 11:
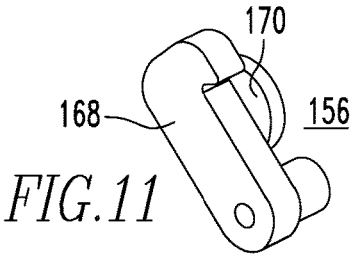
FIG. 11 and FIG. 12 are front isometric and rear isometric views, respectively, of a pawl for the switching assembly of FIG. 5.
Figure 12:
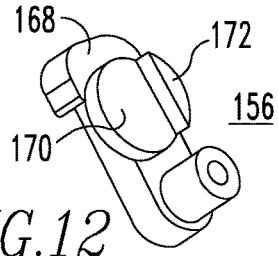
Figure 13:
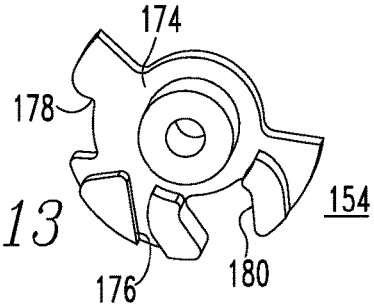
FIG. 13 and FIG. 14 are front isometric and rear isometric views, respectively, of a rotary member for the switching assembly of FIG. 5.
Figure 14:
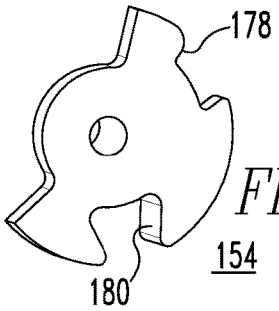
Figure 15:
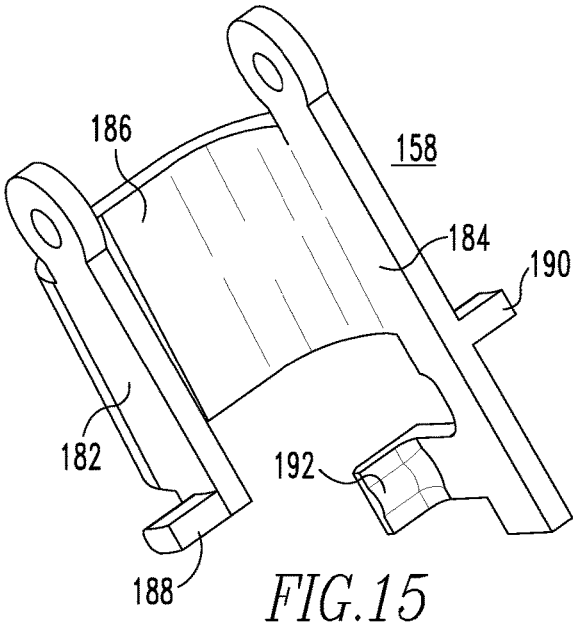
FIG. 15 and FIG. 16 are front isometric and rear isometric views, respectively, of a separator member for the switching assembly of FIG. 5.
Figure 16:
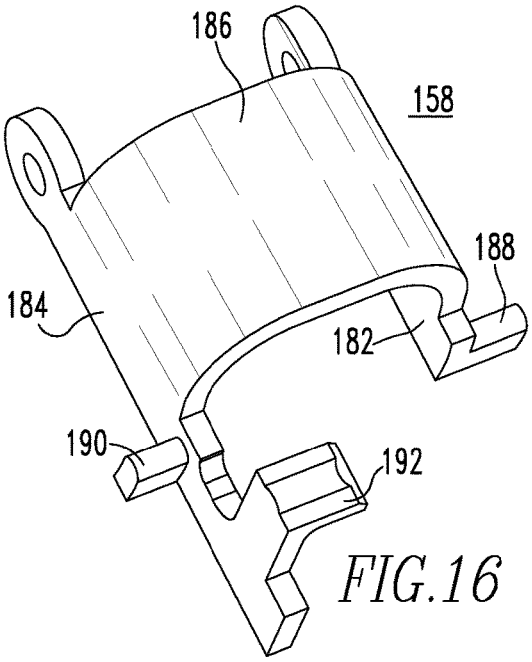

FIGS. 2-5 show different views of the circuit breaker 10, with FIGS. 2-4 showing the transfer assembly 130 in a FIRST position corresponding to the movable contacts 110, 112 being in the CLOSED position, and FIG. 5 showing the transfer assembly 130 having been moved to a SECOND position corresponding to the movable contacts 110,112 being the OPEN position. The transfer assembly 130 includes a number of other components in addition to the single motor 132. More specifically, the transfer assembly 130 includes first and second elements (e.g., without limitation, mounting plates 134 (also shown in FIGS. 9 and 10),136), a first gear member 150 (also shown in FIG. 6), a second gear member 152 (also shown in FIGS. 7 and 8) that cooperates with the first gear member 150, a rotary member 154 (also shown in FIGS. 13 and 14), a locking pawl 156 (also shown in FIGS. 11 and 12), a separator member 158 (also shown in FIGS. 15 and 16), a first driven shaft 159, a second driven shaft 161, and first and second biasing elements (e.g., without limitation, torsional springs 198,206).

The construction and/or geometry of the components of the transfer assembly 130 will now be described in detail. It will be appreciated that the construction and/or geometry of the components of the transfer assembly 130 is exemplary only, and that suitable alternative constructions are within the scope of the disclosed concept. The motor 132 has the body portion 138, and also has a rotary drive shaft 140 extending from and being structured to be rotationally driven by the body portion 138. One non-limiting example motor that may be employed as the motor 132 is Digi-Key Part Number 1528-1150-ND, manufactured by Adafruit Industries LLC, based in New York City, N.Y. Although alternative actuators (e.g., without limitation, solenoids) in addition to motors are contemplated by the disclosed concept, it will be appreciated that by using an actuator such as the motor 132, the transfer assembly 130 is advantageously able to be relatively compact, thereby resulting in the footprint of the circuit breaker 10 being able to be substantially the same as the footprint of two-pole circuit breakers that are not remotely operable. As a result, the circuit breaker 10 can be accommodated by existing load centers without requiring significant and/or any modification to the load centers. Regarding the material nature of some of the components, the first and second gear members 150,152, the rotary member 154, the locking pawl 156, and the separator member 158 are made of any suitable material known in the art. In one example embodiment, the material is a glass reinforced nylon based thermoplastic.

The drive shaft 140 of the motor 132 extends through a thru hole in, and is thereby coupled to, the first gear member 150. The first mounting plate 134 (also shown in FIGS. 9 and 10) has a planar portion 142 coupled to the motor 132, a protrusion 144 extending outwardly from the planar portion 142, and a hook portion 146 also extending outwardly from the planar portion 142. The second mounting plate 136 (see FIG. 3) has a planar portion 147 and a hook portion 149 extending outwardly from the planar portion 147. The planar portions 142,147 of the mounting plates 134,136 are generally parallel to each other, and are coupled to the base 12 (FIG. 1) by any suitable mechanism known in the art (e.g., without limitation, a slot and groove mechanism). The second gear member 152 (see FIGS. 7 and 8) has a body portion 160, a first protrusion 162 extending from the body portion 160, and a second protrusion 164 extending from the body portion 160. Additionally, the body portion 160 has an edge portion 166 defining a thru hole, the function of which will be appreciated below.

The rotary member 154 (see FIGS. 13 and 14) has a body portion 174 having a number of grooved regions 176,178, 180. The locking pawl 156 (see FIGS. 11 and 12) has a body portion 168, a generally disc-shaped protrusion 170 extending outwardly from the body portion 168, and a partially disc-shaped protrusion 172 extending outwardly from the protrusion 170. The separator member 158 (see FIGS. 15 and 16) has first and second arm portions 182,184, and a generally U-shaped middle portion 186 extending between the arm portions 182,184. The arm portions 182,184 are each coupled to the base 12 (FIG. 1) of the circuit breaker 10. The first arm portion 182 has a protrusion 188 extending generally perpendicularly outwardly from a body portion of the first arm portion 182. The second arm portion 184 has protrusions 190,192 that generally extend perpendicularly from, and in opposing directions from, a body portion of the second arm portion 184. The torsional springs 198,206 each have corresponding first end portions 200,208 and corresponding opposing second end portions 202,210.

Referring again to FIGS. 1-5, the configuration and/or assembly of the circuit breaker 10 and switching assembly 100 therefor will now be described in detail. It will be appreciated that the following configuration and/or assembly is exemplary only, and that alternative implementations of the disclosed concept are contemplated herein. The first and second driven shafts 159,161 are coupled to and extend between the mounting plates 134,136. The first driven shaft 159, as shown in FIG. 4, extends through the second gear member 152, the rotary member 154, and the torsional spring 206. The second driven shaft 161, as shown in FIG. 4, extends through the locking pawl 156 and the torsional spring 198. The first gear member 150 cooperates with the body portion 160 of the second gear member 152. That is, the teeth of the first gear member 150 are interlocked with the teeth of the body portion 160 of the second gear member 152 in order to drive the second gear member 152, as will be discussed below. The second gear member 152 is oriented such that the protrusions 162,164 each extend from the body portion 160 away from the motor 132. The first gear member 150, the second gear member 152, the rotary member 154, and the locking pawl 156 are generally located between the mounting plates 134,136. As such, it will be appreciated that the body portion 138 of the motor 132 is located on a first side of the planar portion 142 of the mounting plate 134, and the gear members 150,152 are located on a second, opposing side of the planar portion 142 of the mounting plate 134.

Additionally, as shown most clearly in FIG. 3, the protrusion 144 of the first mounting plate 134 extends at least partially into the thru hole defined by the edge portion 166 of the second gear member 152. In one example embodiment, the protrusion 144 extends entirely through the thru hole defined by the edge portion 166. In this manner, the protrusion 144 provides rotational control to the second gear member 152 when the transfer assembly 130 moves between the FIRST position and the SECOND position.

The first end portion 200 of the torsional spring 198 engages and is maintained in a fixed position by the hook portion 146, and the second end portion 202 engages the protrusion 170 of the locking pawl 156. The protrusion 170 extends from the body portion 168 of the locking pawl 156 toward the mounting plate 134, and the protrusion 172 extends from the protrusion 170 toward the mounting plate 134. As such, it will be appreciated that the protrusion 172 of the locking pawl 156 provides an additional mechanism to maintain the second end portion 202 on the locking pawl 156. That is, during operation, if the second end portion 202 begins to slide away from the body portion 168 of the locking pawl 156, the protrusion 172 advantageously catches the second end portion 202, or prevents the second end portion 202 from being ejected. In this manner, the torsional spring 198 biases the locking pawl 156 toward the FIRST position (FIGS. 1-4).

As shown most clearly in FIG. 4, which is depicted without the second mounting plate 136, when the transfer assembly 130 is in the FIRST position, the body portion 168 of the locking pawl 156 extends into and is interlocked with the grooved region 178 of the rotary member 154. Continuing to refer to FIG. 4, the second end portion 210 of the torsional spring 206 engages and is maintained in the grooved region 176 of the rotary member 154. The first end portion 208 of the torsional spring 206 engages and is maintained in a fixed position by the hook portion 149 of the second mounting plate 136, as shown in FIG. 3. In this manner, the torsional spring 206 biases the rotary member 154 toward the SECOND position (FIG. 5).

Referring again to FIG. 4, the protrusion 192 of the second arm portion 184 of the separator member 158 extends into and engages the grooved region 180 of the rotary member 154. Additionally, the movable contacts 110,112 each have body portions 114,116 and protrusions 118,120 extending from and being generally perpendicular to the body portions 114,116. In one example embodiment, the protrusions 118,120 extend from their corresponding body portions 114,116 toward each other. As shown in FIG. 4, the protrusions 188,190 of the separator member 158 each engage a corresponding one of the protrusions 118,120 of the movable contacts 110,112. Furthermore, the motor 132 is generally located between the arm portions 182,184, and also between the movable contacts 110,112.

Referring to FIGS. 4 and 5, operation of the circuit breaker 10 and switching assembly 100 therefor will now be discussed in greater detail. As previously mentioned, the transfer assembly 130 is structured to move between a FIRST position (FIG. 4) corresponding to the movable contacts 110,112 being in the CLOSED position, and a SECOND position (FIG. 5) corresponding to the movable contacts 110,112 being in the OPEN position. Movement of the transfer assembly 130 is initiated by a signal being sent from the wireless communication device 4 (FIG. 1) to the controller 139 (FIG. 1) of the motor 132. Movement will first be described in association with the transfer assembly 130 moving from the FIRST position (FIG. 4) to the SECOND position (FIG. 5), and then in association with the transfer assembly 130 moving from the SECOND position (FIG. 5) to the FIRST position (FIG. 4).

When the transfer assembly 130 moves from the FIRST position to the SECOND position, the drive shaft 140 causes the first gear member 150 to rotate in the counterclockwise direction, with respect to the orientation of FIG. 4. This causes the second gear member 152, and thus the protrusion 162 of the second gear member 152, to rotate in the clockwise direction, with respect to the orientation of FIG. 4. In other words, when the transfer assembly 130 moves from the FIRST position toward the SECOND position, the first gear member 150 drives the second gear member 152. As the second gear member 152 (i.e., and the protrusion 162) rotates, the protrusion 162 of the second gear member 152 engages the protrusion 170 of the locking pawl 156, thereby allowing the bias of the torsional spring 198 to be counteracted. In other words, the engagement of the protrusion 162 of the second gear member 152 on the protrusion 170 of the locking pawl 156 causes the locking pawl 156 to rotate about the second driven shaft 161, and move away from the grooved region 178. Stated differently, when the transfer assembly 130 moves from the FIRST position toward the SECOND position, the protrusion 162 of the second gear member 152 engages the pawl 156 in order to release the pawl 156 from the rotary member 154.

As stated above, the torsional spring 206 biases the rotary member 154 toward the SECOND position. Accordingly, once the locking pawl 156 is released from the grooved region 178 of the rotary member 154 via the aforementioned engagement with the protrusion 162 of the second gear member 152, the torsional spring 206 is free to drive (i.e., cause to rotate) the rotary member 154. That is, when the transfer assembly 130 moves from the FIRST position toward the SECOND position, the torsional spring 206 drives the rotary member 154 in the clockwise direction, with respect to the orientation of FIG. 4. By employing a spring loaded actuator (i.e., the torsional spring 206), the likelihood of contact welds associated with opening of the movable contacts 110,112 may be minimized, for example because of the inertia provided by the torsional spring 206.

As shown in FIG. 5, this corresponds to the grooved region 180 of the rotary member 154 engaging and pressing the protrusion 192 of the separator member 158. As the separator member 158 is preferably a single unitary component made from a single piece of material, movement of the protrusion 192 via the grooved region 180 of the rotary member 154 translates to each of the protrusions 188,190 of the separator member 158 driving a corresponding one of the protrusions 118,120 of the movable contacts 110,112 in order to move the movable contacts 110,112 from the CLOSED position to the OPEN position. Stated differently, when the transfer assembly 130 moves from the FIRST position toward the SECOND position, the motor 132 cooperates with the separator member 158 to drive the movable contacts 110,112 from the CLOSED position toward the OPEN position. In other words, when the transfer assembly 130 moves from the FIRST position to the SECOND position, the rotary member 154 drives the separator member 158, thereby causing the movable contacts 110,112 to move from the CLOSED position toward the OPEN position.

It follows that one advantage of the non-limiting exemplary embodiment pertains to the manner in which the arm portions 182,184 of the separator member 158 pivot. Specifically, as shown most clearly in FIG. 3, the top of the body portion 114 of the movable contact 110 has a pivot location that corresponds to (i.e., is generally the same as) a pivot location of the top of the arm portion 182 of the separator member 158. As such, when the transfer assembly 130 moves between the FIRST position and the SECOND position, the arm portions 182,184 of the separator member 158 will pivot together with the body portions 114,116 of the movable contacts 110,112. As a result, there will not be significant levels of friction between these components during operation. Over many cycles of operation, this translates into a beneficial prolonging of the life of the movable contacts 110,112 and the separator member 158, and thus the circuit breaker 10 and switching assembly 100 therefor.

As each of the movable contacts 110,112 of the circuit breaker 10 is able to be opened remotely via the aforementioned process, and also in a traditional manner via common breaker operations, it follows that the circuit breaker 10 can be manufactured to be relatively compact, as compared to prior art remotely operable circuit breakers (not shown), which typically require an additional set of separable contacts in order to perform remote tripping and resetting operations, which causes the prior art circuit breakers to be undesirably large. Stated differently, prior art remotely operable circuit breakers typically require a separate set of contacts that are not able to be operated by a wireless communication device. Additionally, known circuit breakers including actuators commonly require the actuators to be extending from ends of the circuit breakers, increasing the overall length of the circuit breaker, and occupying space in installations typically reserved for running electrical load wires.

As shown in FIG. 1, the circuit breaker 10 has a width W that is about two inches. This advantageously allows the circuit breaker 10 to be employed in load centers without significant and/or any modification to the load centers. That is, many load centers are structured so as to receive two-pole circuit breakers that are about two inches wide. Additionally, the circuit breaker 10 is further able to be relatively compact and relatively inexpensive to manufacture in that it employs only the single motor 132. Specifically, prior art multi-pole remotely operable circuit breakers typically require a different actuator for each pole of the circuit breaker (e.g., a prior art two-pole remotely operable circuit breaker would require two actuators, one per pole), adding cost and making assembly more difficult. Furthermore, because the motor 132 is located between the movable contacts 110,112, and not extending from an end of the circuit breaker, the space for installations typically reserved for running electrical load wires is advantageously not sacrificed.

Continuing to refer to FIGS. 4 and 5, resetting the circuit breaker 10, or moving the movable contacts 110,112 from the OPEN position toward the CLOSED position, will now be described in detail. Similar to the opening operations discussed above, the closing operation involves the sending of a signal with the wireless communication device 4 (FIG. 1) to the motor 132. However, during closing, or, when the transfer assembly 130 moves from the SECOND position (FIG. 5) to the FIRST position (FIG. 4), the drive shaft 140 of the motor 132 causes the first gear member 150 to rotate in the opposite direction, which is clockwise with respect to the orientation of FIG. 5. This causes the second gear member 152, and the corresponding protrusion 164, to rotate counterclockwise with respect to the orientation of FIG. 5. As the second gear member 152 is driven by the first gear member 150 in this manner, the protrusion 164 of the second gear member engages and drives the body portion 174 of the rotary member 154, causing the rotary member 154 to rotate in the counterclockwise direction, with respect to the orientation of FIG. 5. As the rotary member 154 is driven, or rotated, by the protrusion 164 of the second gear member 152, the grooved region 178 of the rotary member 154 rotates back toward an engaged and interlocked position with the locking pawl 156 (e.g., as discussed above, the locking pawl 156 is biased toward the FIRST position). Simultaneously, it will be appreciated that while the rotary member 154 is driven by the second gear member 152, the torsional spring 206 is reloaded to its original position, and thus positioned to open the movable contacts 110,112 when actuated. Compare, for example, the positions of the grooved region 178 of the rotary member 154, and the locking pawl 156, as the rotary member 154 is rotated from its position in FIG. 5 to its position in FIG. 4. In other words, when the transfer assembly 130 moves from the SECOND position toward the FIRST position, the protrusion 164 of the second gear member 152 drives the rotary member 154 toward the FIRST position in order to allow the locking pawl 156 to interlock with the rotary member 154 in the FIRST position.

As this is happening, the grooved region 180 of the rotary member 154 drives the protrusion 192 of the separator member 158 back toward the FIRST position (FIG. 4). As a result, the mechanism springs of the circuit breaker 10 are advantageously free to move the movable contacts 110,112 from the OPEN position back to the CLOSED position. Rewinding the separator member 158 and allowing the mechanism springs to close the movable contacts 110,112 also controls the contact closing speeds in a manner proportional to how fast the motor 132 is spun, thus optimizing switching performance. For example, closing velocity in prior art circuit breakers (not shown) is often too high, resulting in the contacts bouncing, thus promoting contact welds.

Figure 17:
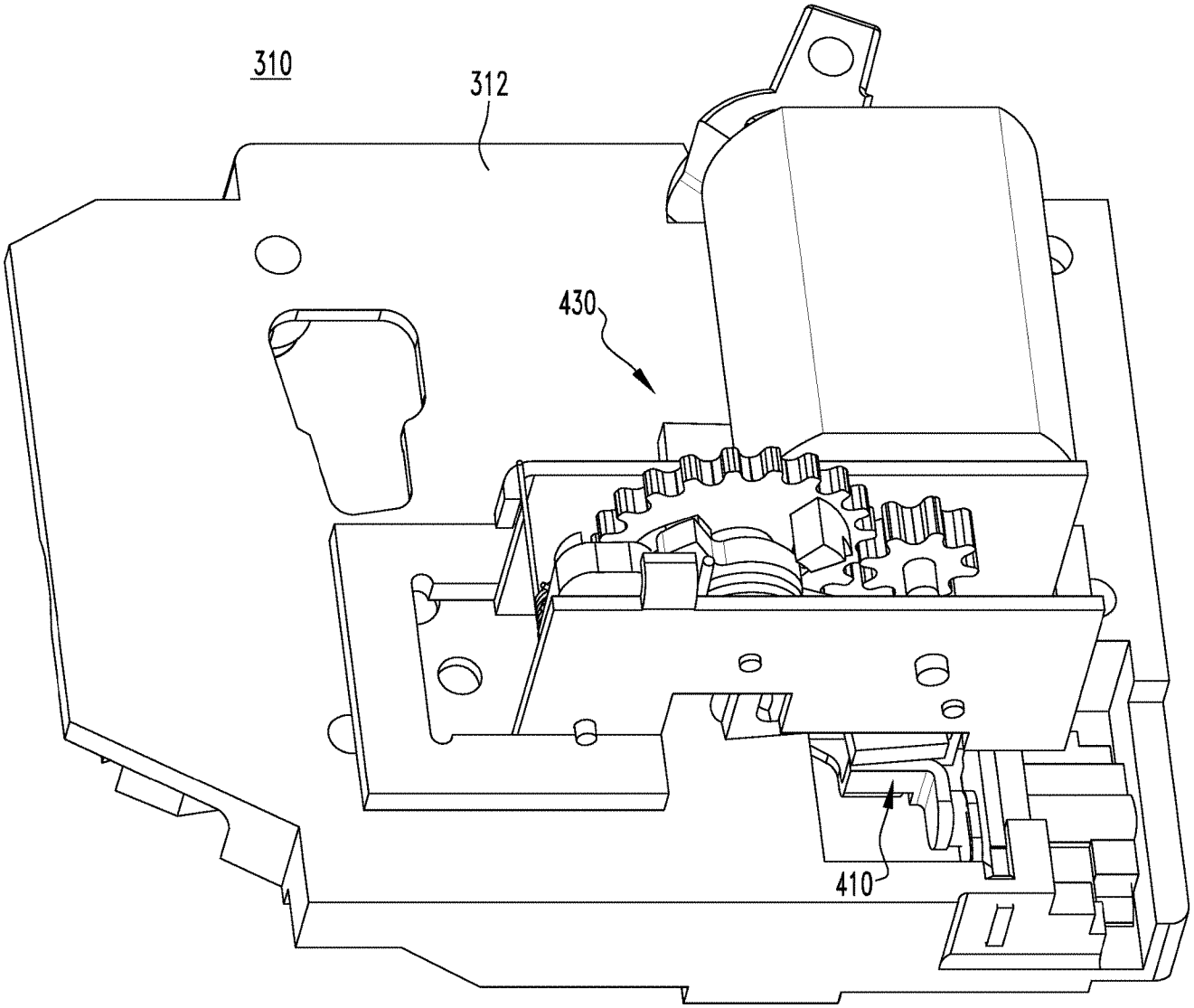
FIG. 17 is a front isometric view of a portion of another electrical switching apparatus and switching assembly therefor, in accordance with another non-limiting embodiment of the disclosed concept.
Figure 18:
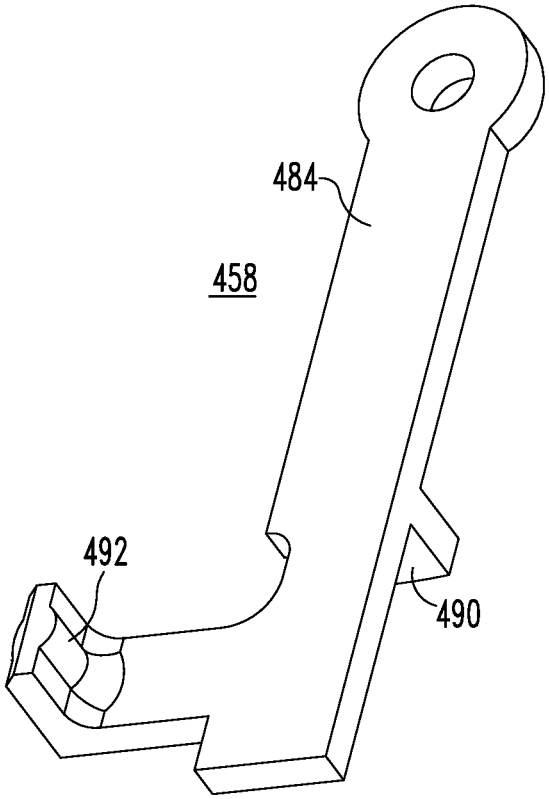
FIG. 18 and FIG. 19 are front isometric and rear isometric views, respectively, of a separator member for the electrical switching apparatus and switching assembly therefor of FIG. 17.
Figure 19:
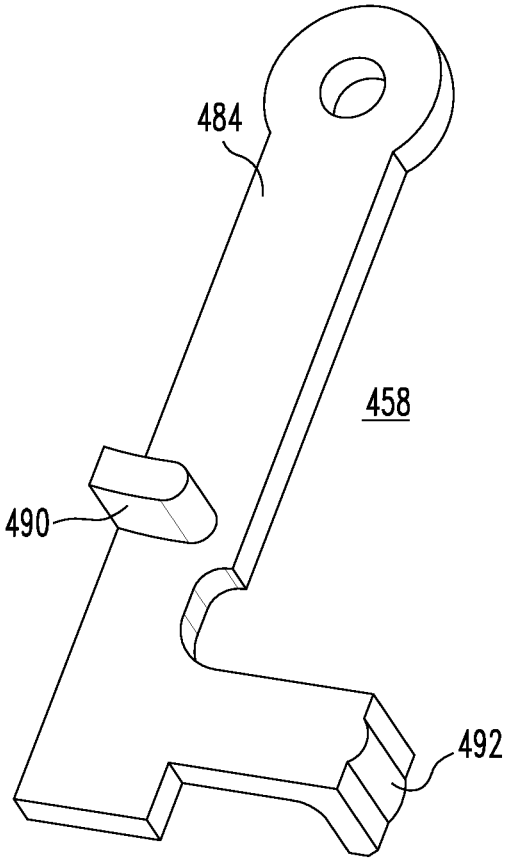

Although the disclosed concept has been described thus far in association with the two-pole circuit breaker 10, suitable alternative electrical switching apparatus (e.g., without limitation, one-pole circuit breaker 310, partially shown in FIG. 17) are within the scope of the disclosed concept. The circuit breaker 310 is remotely operable (i.e., via a wireless communication device such as the wireless communication device 4, shown in FIG. 1) in a similar manner as the circuit breaker 10, discussed above. Specifically, the transfer assembly 430 of the circuit breaker 310 is substantially the same as the transfer assembly 130 of the circuit breaker 10. However, since the circuit breaker 310 only has one single contact assembly having the movable contact 410, which is coupled to the base 312, the transfer assembly 430 has been modified to employ a different separator member 458 than the transfer assembly 130. As shown in FIGS. 18 and 19, the separator member 458 has one single arm portion 484 having protrusions 490,492 that generally extend perpendicularly from, and in opposing directions from, a body portion of the arm portion 484. Similar to the transfer assembly 130 of the circuit breaker 10, the protrusion 492 of the separator member 458 is driven by a grooved region of the rotary member (shown but not labeled in FIG. 17) of the transfer assembly 430. During opening, this causes the protrusion 490 to engage a corresponding protrusion of the movable contact 410, in a similar manner in which the protrusions 188,190 of the separator member 158 engage the protrusions 118,120 of the movable contacts 110,112 of the circuit breaker 10 to move them to the OPEN position.

Furthermore, although the disclosed concept has been described in association with the motor 132 opening and closing the movable contacts 110,112 via the rotary member 154, the locking pawl 156, and the torsional springs 198,206 working together to move the separator member 158, suitable alternative switching assemblies are contemplated herein. For example and without limitation, it is within the scope of the disclosed concept to have a more simplified direct linkage between a motor and a separator member through gear members, without a rotary member, locking pawl, or torsional spring intervening. In such an implementation of the disclosed concept, contact opening may be enhanced such that there may be a snap-action mechanism to opening the contacts. As a result, switching life of the circuit breaker may be enhanced.

Accordingly, it will be appreciated that the disclosed concept provides for an improved (e.g., without limitation, more compact, less expensive to manufacture, better able to be accommodated in a load center), switching system 2, and electrical switching apparatus 10,310 and switching assembly 100 therefor, in which the same set of contacts 106,108, 110,112,410 are employed to perform remote switching operations, as well as traditional switching operations.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. A switching assembly for an electrical switching apparatus of a switching system, said electrical switching apparatus comprising a base, said switching system comprising a communication device, said switching assembly comprising:

a number of contact assemblies structured to be coupled to said base, each of said number of contact assemblies comprising a stationary contact and a movable contact structured to move between a CLOSED position corresponding to engagement with said stationary contact, and an OPEN position corresponding to disengagement with said stationary contact; and a transfer assembly comprising an element and only one single actuator coupled to said element, said element being structured to be coupled to said base, said single actuator comprising a controller for receiving a signal from said communication device, wherein said single actuator is structured to move said movable contact of each of said number of contact assemblies between the CLOSED position and the OPEN position, and wherein said signal represents an instruction to said single actuator to move said movable contact of each of said number of contact assemblies between the CLOSED position and the OPEN position;

wherein said single actuator comprises a drive shaft wherein said transfer assembly further comprises a first gear member and a second gear member structured to cooperate with said first gear member; wherein said drive shaft extends through said first gear member; wherein said transfer assembly is structured to move between a FIRST position corresponding to said movable contact being in the CLOSED position, and a SECOND position corresponding to said movable contact being in the OPEN position; and wherein, when said transfer assembly moves from the FIRST position toward the SECOND position, said first gear member drives said second gear member; and wherein said second gear member has a thru hole; wherein said element comprises a planar portion and a protrusion extending outwardly from said planar portion; and wherein said protrusion extends into the thru hole in order to provide rotational control to said second gear member when said transfer assembly moves between the FIRST position and the SECOND position.

2. The switching assembly of claim 1 wherein said single actuator is a motor; and wherein said communication device is a wireless communication device.

3. The switching assembly of claim 2 wherein said number of contact assemblies comprises a first contact assembly and a second contact assembly.

4. The switching assembly of claim 3 wherein said transfer assembly is structured to move between a FIRST position corresponding to said movable contact of said first contact assembly and said second contact assembly being in the CLOSED position, and a SECOND position corresponding to said movable contact of said first contact assembly and said second contact assembly being in the OPEN position; wherein said transfer assembly further comprises a separator member structured to be coupled to said base; wherein said separator member engages said movable contact of each of said first contact assembly and said second contact assembly; and wherein, when said transfer assembly moves from the FIRST position toward the SECOND position, said motor cooperates with said separator member to drive said movable contact of each of said first contact assembly and said second contact assembly from the CLOSED position toward the OPEN position.

5. The switching assembly of claim 4 wherein said separator member comprises a first arm portion, a second arm portion, and a middle portion extending between the first arm portion and the second arm portion; wherein the first arm portion is structured to be coupled to said base, and engage said movable contact of said first contact assembly; wherein the second arm portion is structured to be coupled to said base, and engage said movable contact of said second contact assembly; and wherein said motor is disposed between the first arm portion and the second arm portion.

6. A switching assembly for an electrical switching apparatus of a switching system, said electrical switching apparatus comprising a base, said switching system comprising a communication device, said switching assembly comprising:

a number of contact assemblies structured to be coupled to said base, each of said number of contact assemblies comprising a stationary contact and a movable contact structured to move between a CLOSED position corresponding to engagement with said stationary contact, and an OPEN position corresponding to disengagement with said stationary contact; and a transfer assembly comprising an element and only one single actuator coupled to said element, said element being structured to be coupled to said base, said single actuator comprising a controller for receiving a signal from said communication device, wherein said single actuator is structured to move said movable contact of each of said number of contact assemblies between the CLOSED position and the OPEN position, and wherein said signal represents an instruction to said single actuator to move said movable contact of each of said number of contact assemblies between the CLOSED position and the OPEN position;

wherein said single actuator comprises a drive shaft wherein said transfer assembly further comprises a first gear member and a second gear member structured to cooperate with said first gear member; wherein said drive shaft extends through said first gear member; wherein said transfer assembly is structured to move between a FIRST position corresponding to said movable contact being in the CLOSED position, and a SECOND position corresponding to said movable contact being in the OPEN position; and wherein, when said transfer assembly moves from the FIRST position toward the SECOND position, said first gear member drives said second gear member; and wherein said single actuator further comprises a body portion; wherein said drive shaft extends from said body portion; wherein said element comprises a planar portion having a first side and a second side opposite the first side; wherein said body portion is disposed on the first side; and wherein said first gear member and said second gear member are disposed on the second side.

7. The switching assembly of claim 6 wherein said single actuator is a motor; and wherein said communication device is a wireless communication device.

8. The switching assembly of claim 7 wherein said number of contact assemblies comprises a first contact assembly and a second contact assembly.

9. The switching assembly of claim 8 wherein said transfer assembly is structured to move between a FIRST position corresponding to said movable contact of said first contact assembly and said second contact assembly being in the CLOSED position, and a SECOND position corresponding to said movable contact of said first contact assembly and said second contact assembly being in the OPEN position; wherein said transfer assembly further comprises a separator member structured to be coupled to said base; wherein said separator member engages said movable contact of each of said first contact assembly and said second contact assembly; and wherein, when said transfer assembly moves from the FIRST position toward the SECOND position, said motor cooperates with said separator member to drive said movable contact of each of said first contact assembly and said second contact assembly from the CLOSED position toward the OPEN position.

10. The switching assembly of claim 9 wherein said separator member comprises a first arm portion, a second arm portion, and a middle portion extending between the first arm portion and the second arm portion; wherein the first arm portion is structured to be coupled to said base, and engage said movable contact of said first contact assembly; wherein the second arm portion is structured to be coupled to said base, and engage said movable contact of said second contact assembly; and wherein said motor is disposed between the first arm portion and the second arm portion.

11. A switching assembly for an electrical switching apparatus of a switching system, said electrical switching apparatus comprising a base, said switching system comprising a communication device, said switching assembly comprising:

a number of contact assemblies structured to be coupled to said base, each of said number of contact assemblies comprising a stationary contact and a movable contact structured to move between a CLOSED position corresponding to engagement with said stationary contact, and an OPEN position corresponding to disengagement with said stationary contact; and a transfer assembly comprising an element and only one single actuator coupled to said element, said element being structured to be coupled to said base, said single actuator comprising a controller for receiving a signal from said communication device, wherein said single actuator is structured to move said movable contact of each of said number of contact assemblies between the CLOSED position and the OPEN position, and wherein said signal represents an instruction to said single actuator to move said movable contact of each of said number of contact assemblies between the CLOSED position and the OPEN position;

wherein said single actuator comprises a drive shaft wherein said transfer assembly further comprises a first gear member and a second gear member structured to cooperate with said first gear member; wherein said drive shaft extends through said first gear member;

wherein said transfer assembly is structured to move between a FIRST position corresponding to said movable contact being in the CLOSED position, and a SECOND position corresponding to said movable contact being in the OPEN position; and wherein, when said transfer assembly moves from the FIRST position toward the SECOND position, said first gear member drives said second gear member; and wherein said transfer assembly further comprises a rotary member, a pawl, a first driven shaft, and a second driven shaft; wherein said first driven shaft and said second driven shaft are each coupled to said element; wherein said first driven shaft extends through said second gear member and said rotary member; wherein said second driven shaft extends through said pawl; wherein, when said transfer assembly is in the FIRST position, said pawl is interlocked with said rotary member; and wherein when said transfer assembly moves from the FIRST position toward the SECOND position, said second gear member engages said pawl in order to release said pawl from said rotary member.

12. The switching assembly of claim 11 wherein said second gear member comprises a body portion, a first protrusion, and a second protrusion; wherein said body portion cooperates with said first gear member; wherein said first protrusion and said second protrusion each extend from said body portion away from said single actuator; wherein, when said transfer assembly moves from the FIRST position toward the SECOND position, said first protrusion engages said pawl in order to release said pawl from said rotary member; and wherein, when said transfer assembly moves from the SECOND position toward the FIRST position, said second protrusion drives said rotary member toward the FIRST position in order to allow said pawl to interlock with said rotary member in the FIRST position.

13. The switching assembly of claim 11 wherein said transfer assembly further comprises a separator member structured to be coupled to said base; wherein said separator member extends into said rotary member; and wherein, when said transfer assembly moves from the FIRST position toward the SECOND position, said rotary member drives said separator member, thereby causing said movable contact of each of said number of contact assemblies to move from the CLOSED position toward the OPEN position.

14. The switching assembly of claim 11 wherein said transfer assembly further comprises a biasing element; wherein said second driven shaft extends through said biasing element; and wherein said biasing element biases said pawl toward the FIRST position.

15. The switching assembly of claim 14 wherein said pawl comprises a body portion and a protrusion extending from said body portion toward said element; wherein said body portion interlocks with said rotary member when said transfer assembly is in the FIRST position; wherein said biasing element is a torsional spring having a first end portion and a second end portion disposed opposite the first end portion; wherein the first end portion engages said element; and wherein the second end portion engages said protrusion.

16. The switching assembly of claim 11 wherein said transfer assembly further comprises a biasing element; wherein said first driven shaft extends through said biasing element; and wherein, when said transfer assembly moves from the FIRST position toward the SECOND position, said biasing element drives said rotary member.

17. The switching assembly of claim 16 wherein said transfer assembly further comprises a second element structured to be coupled to said base; wherein said rotary member, said first gear member, said second gear member, and said pawl are disposed between said element and said second element; wherein said rotary member has a grooved region; wherein said biasing element is a torsional spring having a first end portion and a second end portion disposed opposite the first end portion; wherein the first end portion engages said second element; and wherein the second end portion is disposed in the grooved region.

18. The switching assembly of claim 11 wherein said single actuator is a motor; and wherein said communication device is a wireless communication device.

19. The switching assembly of claim 18 wherein said number of contact assemblies comprises a first contact assembly and a second contact assembly.

20. The switching assembly of claim 19 wherein said transfer assembly is structured to move between a FIRST position corresponding to said movable contact of said first contact assembly and said second contact assembly being in the CLOSED position, and a SECOND position corresponding to said movable contact of said first contact assembly and said second contact assembly being in the OPEN position; wherein said transfer assembly further comprises a separator member structured to be coupled to said base; wherein said separator member engages said movable contact of each of said first contact assembly and said second contact assembly; and wherein, when said transfer assembly moves from the FIRST position toward the SECOND position, said motor cooperates with said separator member to drive said movable contact of each of said first contact assembly and said second contact assembly from the CLOSED position toward the OPEN position.

* * * * *